United States Patent [19]

Nilsson

[11] 4,363,150

[45] Dec. 14, 1982

[54] SHIP'S EMBARKATION DEVICE

[75] Inventor: Emanuel Nilsson, Västra Frölunda, Sweden

[73] Assignee: AB Welin, Goteborg, Sweden

[21] Appl. No.: 185,905

[22] PCT Filed: Mar. 12, 1979

[86] PCT No.: PCT/SE79/00052

§ 371 Date: Nov. 17, 1979

§ 102(e) Date: Nov. 13, 1979

[87] PCT Pub. No.: WO79/00784

PCT Pub. Date: Oct. 18, 1979

[30] Foreign Application Priority Data

Mar. 17, 1978 [SE] Sweden ..... 7803135

[51] Int. Cl.[3] ..... E01D 1/00

[52] U.S. Cl. ..... 14/69.5; 182/84

[58] Field of Search ..... 14/69.5, 71.5, 1; 414/140; 182/84; 405/303

[56] References Cited

U.S. PATENT DOCUMENTS

| | | | |
|---|---|---|---|
| 298,212 | 5/1984 | Knight | 14/72.5 X |
| 1,343,094 | 6/1920 | Sims | 14/71.1 X |
| 2,362,170 | 11/1944 | Swaisgood | 14/72.5 |
| 2,372,574 | 3/1945 | Haynes | 14/71.1 |
| 2,411,966 | 12/1946 | Hogan | 182/2 |
| 2,738,913 | 3/1956 | Taylor | 182/83 X |
| 3,856,110 | 12/1974 | Nilsson | 182/84 |
| 4,115,887 | 9/1978 | Ewards | 182/84 X |

FOREIGN PATENT DOCUMENTS

| | | | |
|---|---|---|---|
| 1337390 | 11/1973 | United Kingdom | 182/84 |

*Primary Examiner*—Nile C. Byers, Jr.

*Attorney, Agent, or Firm*—Holman & Stern

[57] ABSTRACT

A ship's embarkation device comprising a projecting ladder or similar structure (3), which at one end is pivotally connected to a first platform (2), which is pivotally connected to the ship's deck, and at its other end is pivotally connected to a second platform (4). The first and second platforms are unrotatably connected to each other by a connecting bar (5), which is pivotally connected to both platforms. The connecting bar always keeps the second platform in a horizontal position as well as strengthens the torsional resistance of the device. Moreover the ladder is kept tighter to the ship's deck, which prevents the ladder from swinging as the ship is rolling.

10 Claims, 9 Drawing Figures

SHIP'S EMBARKATION DEVICE

BACKGROUND OF THE INVENTION

The present invention relates to a ship's embarkation device comprising at least one projecting means, e.g. a ladder, to the one end of which there is pivotally attached a first platform, which is connected to the ship's deck, and to the opposite end of which a second platform is pivotally attached, wherein at least one connecting bar is pivotally arranged between the first and the second platforms via first and second pivot axles, said device further comprising means for hoisting and lowering the device and for turning the device to and from a stowing position on the deck.

When installing conventional accommodation ladders (Swedish Pat. No. 369.696) which also are intended to be used as embarkation devices for pilots etc. a fairly large-scale operation is required on the ship's deck. The platform, which is pivotally connected to the ship's deck, is via a torsion axle connected to one or even two folding davits, which are to be welded on to the deck. This also applies to the supports for the torsion axle. The davits and the wires running via them keep the second "lower" platform in parallel with the ship's deck. The ladder is operated by means of wires, which run from the ladder via the davits to brackets and to a winch each. The brackets have to be welded on to the deck as well, and take up some space. This type of accommodation ladder fulfils very high demands for safety concerning embarkation of e.g. pilots and the operation of the ladder and is mainly intended for large ships.

It is previously known to parallel the steps of accommodation ladders by means of a connecting bar, e.g. as shown in the Danish Pat. No. 5764, the British Pat. No. 608.424 and the German Pat. No. 676.825. These connecting bars do however not strengthen the torsional resistance of the accommodation ladder.

BRIEF SUMMARY OF THE INVENTION

The purpose of the present invention is to provide a constructively simple and thereby cheaper embarkation device, by which a simplified installation is achieved at the same time as a perfectly satisfactory function and safety of the accommodation ladder is maintained and the lower platform will always automatically be kept in a horizontal position. The procedure of turning the device to the stowage position will be simplified as well. According to the invention this has been achieved by the fact that said connecting bar is arranged to strengthen the torsional resistance of the device and to take up the torsional forces between the platforms when the device is turned to and from the stowing position on deck.

The Danish patent specification No. 5764 shows an accommodation ladder with a connecting member, whose purpose, however, is only to parallel the steps of the ladder. This device has no second platform.

The device according to the invention illustrates several important advantages, some of which are mentioned below.

Only a few details have to be welded on to the deck and the stowage space required is exceedingly small. The connecting bar stabilizes the ladder and makes it steadier and safer to walk on. There is no need of davit arms obstructing the through-fare on the ladder when this is hoisted to its upper position. Furthermore, the ladder is kept against the ship's side more firmly than in devices hanging on vertical wires, and this prevents the ladder from swinging when the ship is rolling. The connecting bar always keeps the lower platform in a horizontal position and also takes up the torsional forces between the platforms when the ladder is turned to and from the stowage position.

Further characteristics of the invention will be evident from the following specification, in which some embodiments are more closely described in accordance with the enclosed drawings.

DETAILED DESCRIPTION

Figure 1:
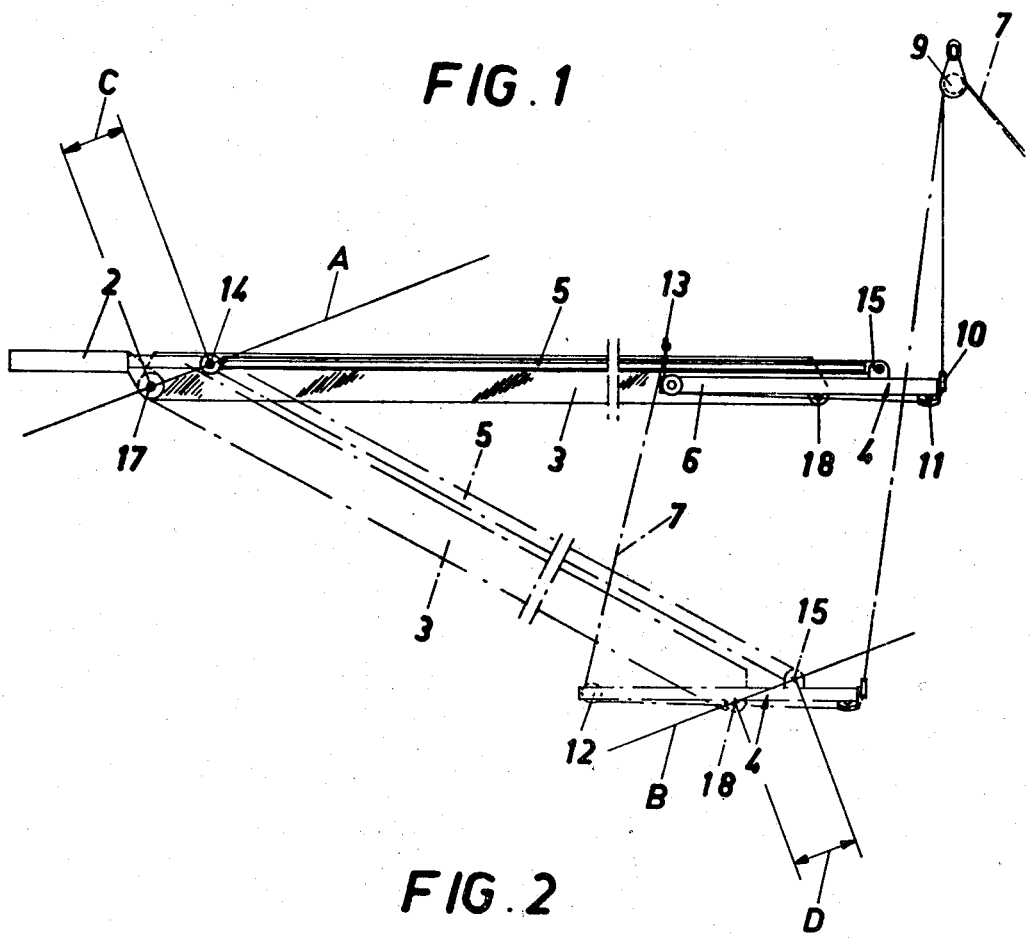
FIG. 1 is a schematic side view of an accommodation ladder according to the invention.

The ship's deck is denoted with the numeral 1. A first "upper" platform 2 is pivotally attached to the deck 1 via a pivot axle 24, and the accommodation ladder 3 is pivotally mounted to said platform 2 via pivot axles 17. A second platform 4 is pivotally attached to the opposite "lower" end of the ladder 3 via pivot axles 18. The platforms 2 and 4 are connected by means of a torsion connecting bar 5, which is pivotally mounted via pivot axles 14 and 15 to the two platforms, which thereby are always kept parallel to each other, that is horizontal at every position of the ladder. The connecting bar 5 takes up the torsion forces between the platforms 2 and 4 at the turning of the ladder to and from the stowage position. At the second platform 4 there is attached an arm 6 projecting from said platform, which arm extends along the ladder 3 on the inside.

Figure 2:
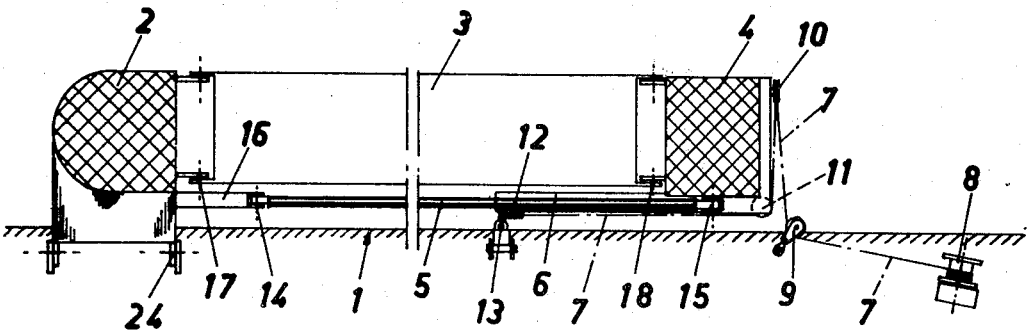
FIG. 2 is a top plan view of the accommodation ladder according to FIG. 1.

The accommodation ladder is supported by at least one wire 7 which according to the embodiment in FIGS. 1 and 2 runs from a winch 8 through a block 9 arranged above the deck, e.g. at an upper deck, mast or similarly useful part of the ship, and around pulley 10 at the outer corner of the second platform 4 remote from the ladder 3, around a pulley 11 at the inner corner of platform 4 remote from the ladder 3, along the inside of the arm 6, around a pulley 12 at the free end of the arm 6 and to an attachment 13 to the deck 1. The hoisting of the accommodation ladder is thus performed with double wire parts, whereby the winch 8 is exposed to less tension. Only one drum is required on the winch 8.

In this embodiment the pivot axles 14 and 15, respectively, of the connecting bar 5 are mounted on the first and second platforms 2 and 4, respectively, on a support 16 on the inside of the first platform 2 and on arm 6, so that the pivot axles 14 and 15 are located in other vertical planes than the pivot axles 17 and 18, respectively of the ladder 3. By this arrangement a lever effect is achieved, which stabilizes the second platform 4 when the ladder is lowered. FIG. 1 shows with continuous lines the accommodation ladder in a hoisted-up position, while a lowered position is shown with dash-dotted lines.

According to FIG. 1, plane A, going through the axles 14 and 17, is essentially parallel with the plane B going through the axles 15 and 18. This is true for any position of the ladder. Furthermore the distance C between the axles 14 and 17 is essentially equal to the distance D between the axles 15 and 18.

Figure 3:
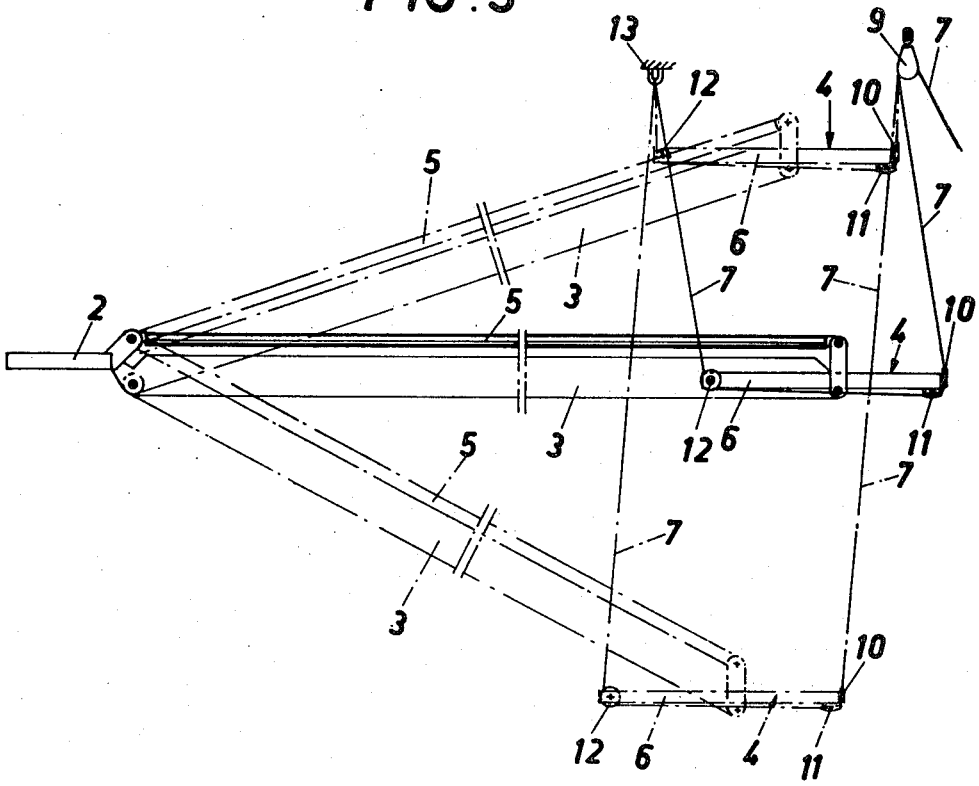
FIG. 3 is a schematic side view of an accommodation ladder according to another embodiment of the invention.
Figure 4:
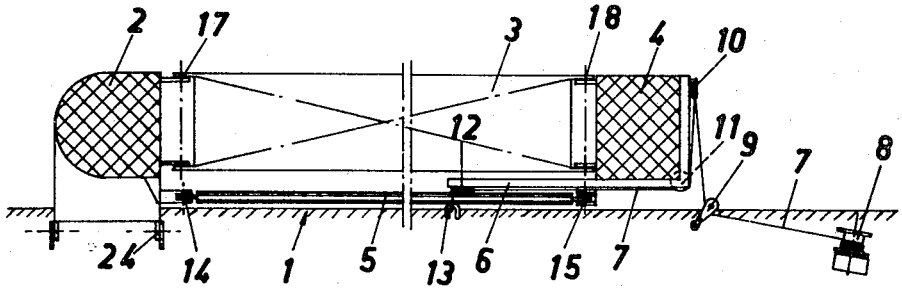
FIG. 4 is a top plan view of the accommodation ladder according to FIG. 3.

In the embodiment of FIGS. 3 and 4 it is possible to hoist the accommodation ladder to a position above the deck 1, which may be desired in harbours with great differences in tide and when ships are so heavily loaded that the deck may be lower than the quay. According to this embodiment the attachment 13 of the wire 7 is therefore arranged above the deck 1 on the same level as the block 9, and the connecting bar 5 is placed at a larger distance from the ladder 3 than in the embodiment of FIGS. 1 and 2, whereby the wire 7 runs between the ladder 3 and the connecting bar 5. The pivot axles 14 and 15 of the connecting bar 5 are located in the vertical planes through the pivot axles 17 and 18, respectively, of the ladder 3 in order to make it possible to raise as well as lower the ladder relative to the deck 1. FIG. 3 shows, with continuous lines, the ladder 3 in a horizontal position at the deck and, with dash-dotted lines, the ladder when hoisted to a position above the deck and lowered to a position below the deck.

Figure 5:
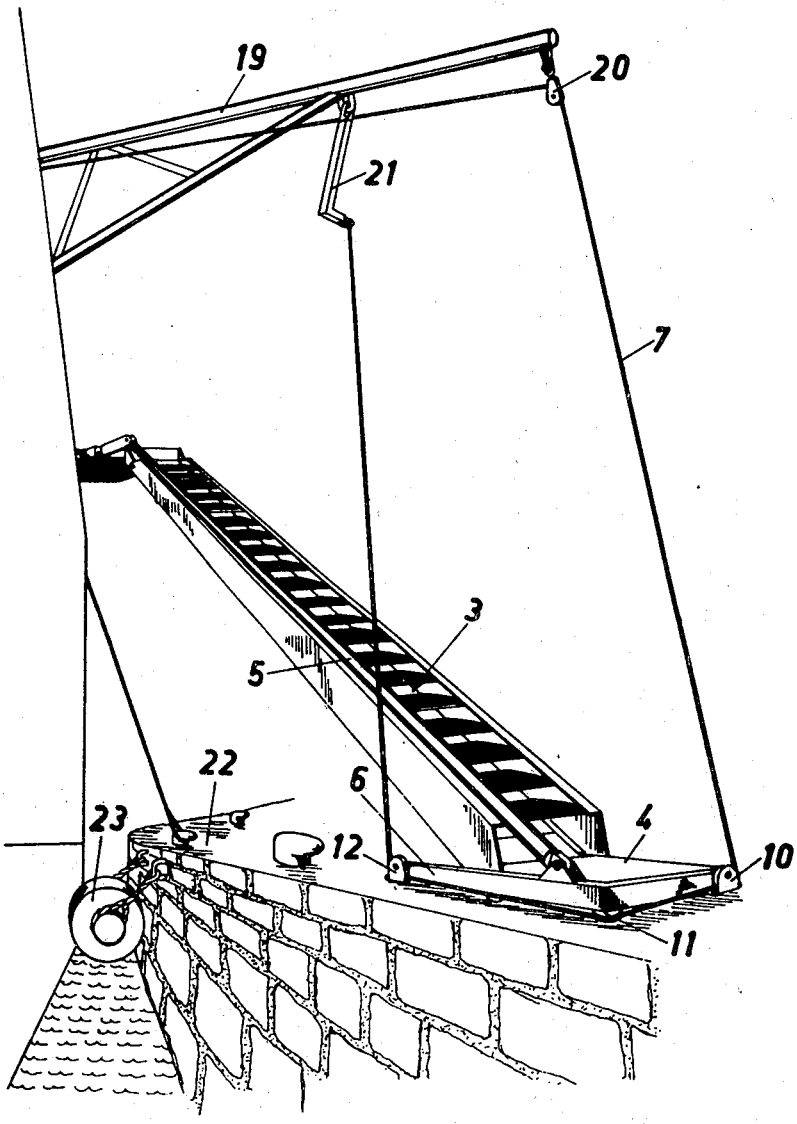
FIG. 5 is a perspective view showing an accommodation ladder according to the invention, provided with a device for swinging the ladder out from the ship's side.

In the embodiment illustrated in FIG. 5 there is arranged on the deck 1 a swing boom 19, at the free end of which is arranged a block 20. The wire 7 runs from the winch via the block 20 to the second platform 4 and back to a hook 21 hanging down from the boom 19, where it is attached. Said hook 21 is intended to catch the ladder 3, when this has been hoisted up to a horizontal position. Instead of the hook 21 a disc or a wire-disc can be arranged on the boom 19. When the ladder has been hoisted so that the pulley 12 reaches the hook 21 or the disc or the attachment point 13 (FIG. 2) the ladder and its platforms are turned up to a vertical position or stowing position due to the fact that pulley 12 on the second platform 4 on the connecting bar 5 is kept in place while the outer further side of the platform 4 is hoisted farther. The torsional movement of the platform 4, thus produced, is transferred to the first platform 2 via the connecting bar 5. By this arrangement the ladder 3 can be swung out from the ship's side by swinging the boom 19. This may be necessary where the ship does not lie close to the quay 22, e.g. due to protecting fenders 23 arranged at the quay 22.

Figure 6:
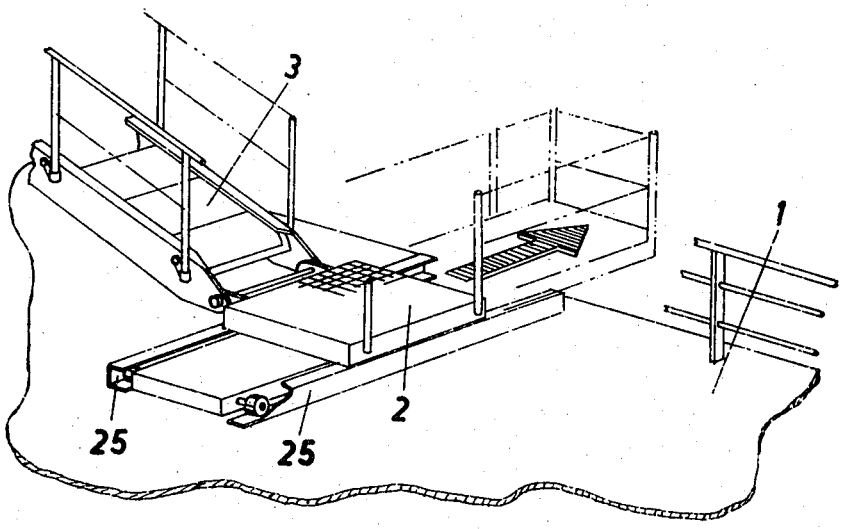
FIG. 6 is a perspective view showing a modification of the upper platform of the accommodation ladder.

In the embodiment according to FIG. 6 the stowage is performed in a somewhat different way. In this case a parallel movement of the accommodation ladder takes place from a position outside the deck 1 to a position on the deck and vice versa. This may be necessary in those cases where the deck 1 is located below the quay and the ship's side is so close to said quay that it is impossible to place the ladder between the ship and the quay. In such a case the ladder 3 can be hoisted up from its position on the deck. Said parallel movement is done by displacing the first platform 2 on the deck 1 in guides 25.

Figure 8:
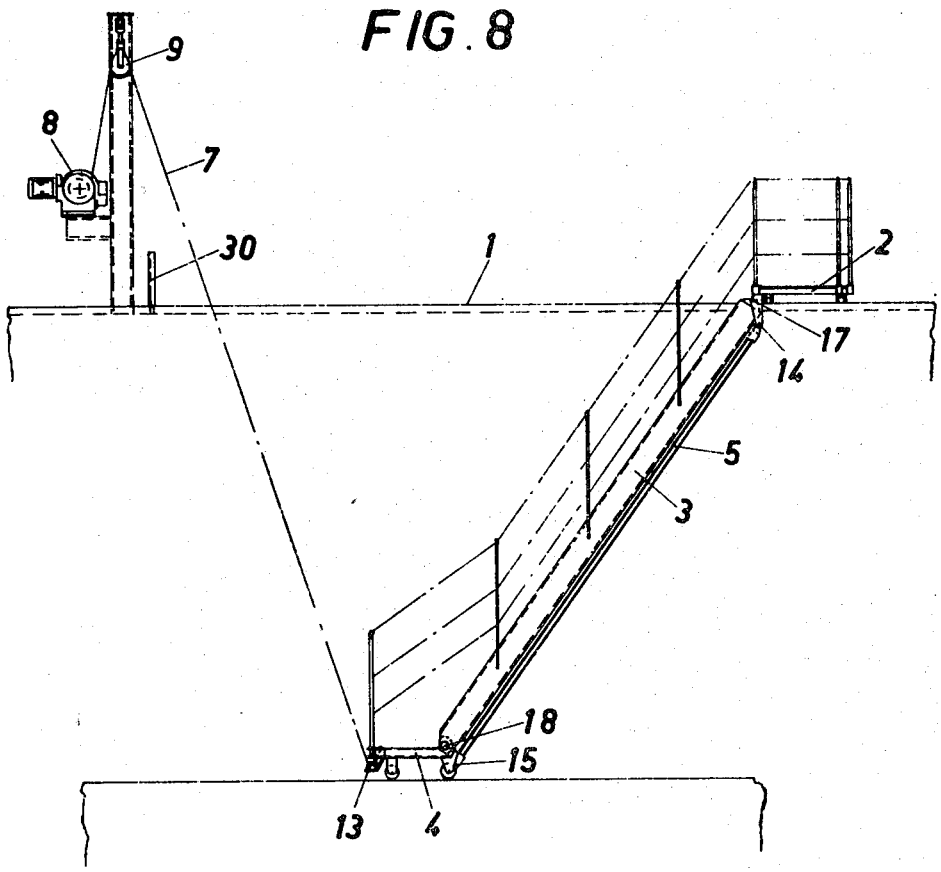
FIG. 8 is a side view of the accommodation ladder according to FIG. 7.
Figure 9:
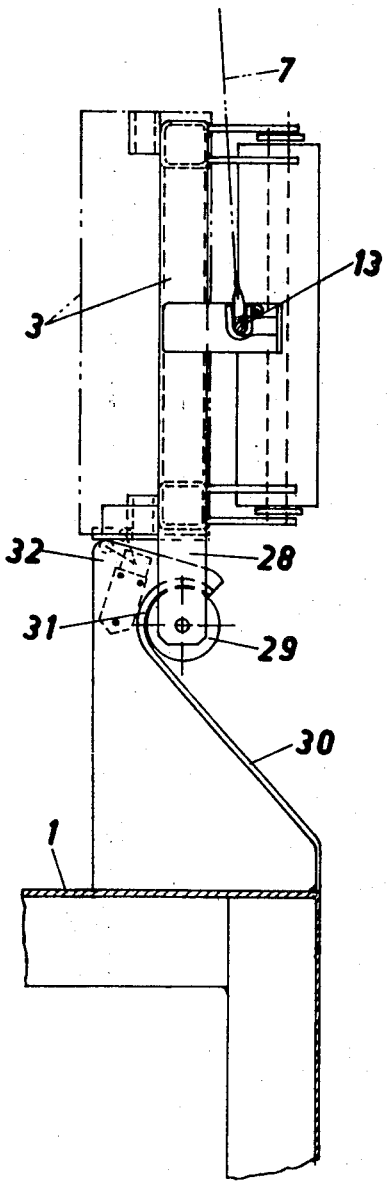
FIG. 9 is an end view of the ladder according to FIGS. 7 and 8 in a stowed position.
Figure 7:
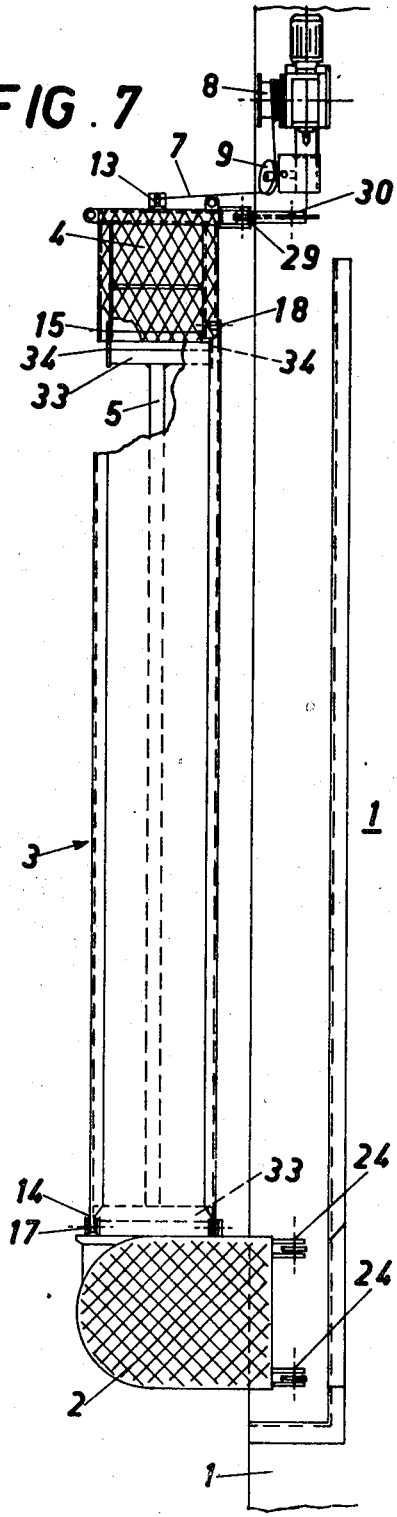
FIG. 7 is a top plan view of a further embodiment.

The embodiment according to the FIGS. 7–9 is primarily intended for small ships and is for this reason further constructively simplified compared to the above described embodiments. Thus the arm 6 is missing and the device is operated only with one wire part 7. The connecting bar 5 is placed under the ladder 3 and is preferably represented by a tube, which at both ends is provided with perpendicularly arranged tubular pieces 33, which by means of discs 34 are pivotally connected to the respective platform 2, 4 via the pivot axles 14 and 25 respectively. By designing the connecting bar 5 in this way it can transfer torsion forces, which is necessary when the ladder is turned to and from its stowing position on the ship's deck.

On the side of the platform 4 facing the ship's side an arm 28 is arranged, at the free end of which a roller 29 is mounted. When the device is hoisted the roller will rest against the ship's side and when the second platform 4 has reached the level of the ship's deck 1 the roller 29 will roll up on a track 30, which at its upper end has a curved portion 31 catching the roller 29, whereby when the wire 7 is further pulled the device will be pivoted about the pivot axles 24 and take the vertical position shown in FIG. 9. In this position the ladder rests on the upper part of a bracket 32, on which also said track is arranged. In this position the device is lashed in a suitable way.

When the device is to be lowered the lashings are released and the wire 7 is slackened, at which the device is lowered in a very simple way.

The invention is not limited to the embodiments shown but can be varied within the scope of the following claims. Thus, instead of the ladder 3, there can be a projecting means comprising a tube or framework construction, on which the person or persons, who are to be taken on board, board(s) the second platform, which by means of the winch is then lifted up on a level with the ship's deck.

What I claim is:

1. A ship's embarkation device comprising at least one projecting means, e.g. a ladder, to the one end of which there is pivotally attached a first platform connected to the ship's deck, and to the opposite end of which a second platform is pivotally attached, at least one torsion bar pivotally attached at its ends between the first and the second platform by first and second pivot axles, said torsion bar being arranged to strengthen the torsional resistance of the device and to take up the torsional forces between the platforms when the device is turned to and from the stowing position on deck, and, means for hoisting and lowering the device and for turning the device to and from a stowing position on deck, including an arm, extending towards, inside and parallel with the projecting means when said projecting means is horizontally attached to said second platform, a first pulley for a wire mounted at the free end of said arm and a second pulley for a wire mounted on the diametrically opposite corner of said second platform with respect to said first pulley.

2. A ship's embarkation device comprising at least one projecting means, e.g. a ladder, to the one end of which there is pivotally attached a first platform connected to the ship's deck, and to the opposite end of which a second platform is pivotally attached, at least one torsion bar disposed under said projecting means, members on the ends of said torsion bar extending perpendicular thereto pivotally attached to the respective first and second platforms by first and second pivot axles, said torsion bar being arranged to strengthen the torsional resistance of the device and to take up the torsional forces between the platforms when the device is turned to and from the stowing position on deck, and means for hoisting and lowering the device and for turning the device to and from a stowing position on deck, including an attachment for a wire from a winch arrangement on the ship's deck arranged on said second platform, a roller arranged at the side of said second platform facing the ship's side, means with a curved path for the roller being arranged on the ship's deck catching the roller when the device is hoisted up to a substantially horizontal position, whereby the device is turned to the stowing position on the deck by further pulling of the wire.

3. A ship's embarkation device comprising:

a first platform, pivotal connection means between said first platform and the ship's deck to facilitate rotation of said platform about the pivotal axis of said pivotal connection from a substantially horizontal position to a stowing position at least substantially parallel to the side of the ship, a projecting means, e.g. a ladder, pivotally attached at one end to said first platform, a second platform pivotally attached to the other end of said projecting means, a torsion bar pivotally connected at one end to said first platform and at its other end to said second platform by first and second pivot axles respectively spaced from said respective pivotal attachments between said platforms and said projecting means so that said platforms are always maintained substantially parallel to each other, and means operably connected to said second platform and said ship for hoisting and lowering said device and for turning the device around the pivotal axis of said first platform pivotal connection to and from a stowing position on deck at least substantially parallel to the side of the ship.

4. A ship's embarkation device according to claim 3, wherein each first and second pivot axle of the torsion bar is arranged in another vertical plane than the respective pivotal attachment of the projecting means.

5. A ship's embarkation device according to claim 3, wherein each first and second pivot axle of the torsion bar is arranged in the same vertical plane as the respective pivotal attachment of the projecting means.

6. A ship's embarkation device according to claim 5, wherein the device is vertically adjustable relative to the deck from a middle position on the deck to a position above the deck and to a position below the deck at the ship's side, respectively.

7. A ship's embarkation device according to claim 3 or claim 1, wherein the torsion bar is arranged parallel with and along the side edge of the projecting means facing the ship's side.

8. A sdhip's embarkation device according to claim 3, wherein said means for hoisting and lowering the device comprises a wire and a swing boom arranged on the deck, a block for the wire and a member to which the wire is attached being arranged at said boom, said member being arranged to catch the projecting means, when this is hoisted up to a horizontal position, at which the device can be turned to the stowing position on the deck at further pulling of the wire.

9. A ship's embarkation device according to claim 3, wherein the torsion bar is arranged under the projecting means and at its ends is provided with members extending perpendicular thereto said members via said first and second pivot axles of the connecting bar being pivotally attached to the respective platform.

10. A ship's embarkation device according to claim 6, wherein the first platform is displaceable in transverse direction of the ship along guides from a position where the device is located on the deck to a position outside the ship's side.

* * * * *